US010412521B2

(12) United States Patent
Vautin et al.

(10) Patent No.: US 10,412,521 B2
(45) Date of Patent: Sep. 10, 2019

(54) SIMULATING ACOUSTIC OUTPUT AT A LOCATION CORRESPONDING TO SOURCE POSITION DATA

(71) Applicant: BOSE CORPORATION, Framingham, MA (US)

(72) Inventors: Jeffery R. Vautin, Worcester, MA (US); Michael S. Dublin, Arlington, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/149,802

(22) Filed: Oct. 2, 2018

(65) Prior Publication Data

US 2019/0037332 A1 Jan. 31, 2019

Related U.S. Application Data

(63) Continuation of application No. 15/831,536, filed on Dec. 5, 2017, now Pat. No. 10,123,145, which is a (Continued)

(51) Int. Cl.
*H04R 5/00* (2006.01)
*H04S 5/00* (2006.01)

(Continued)

(52) U.S. Cl.
CPC ..... *H04S 5/00* (2013.01); *H04R 1/323* (2013.01); *H04S 7/30* (2013.01); *H04S 7/302* (2013.01);

(Continued)

(58) Field of Classification Search
CPC ... H04S 5/00; H04S 7/30; H04S 7/302; H04S 3/008; H04S 2400/03; H04S 2400/11; H04R 1/323; H04R 5/023; H04R 2499/13
See application file for complete search history.

(56) References Cited

U.S. PATENT DOCUMENTS 6,577,738 B2 6/2003 Norris et al.
6,778,073 B2 8/2004 Lutter et al.

(Continued)

FOREIGN PATENT DOCUMENTS

CN 103650535 A 3/2014
CN 104604255 A 5/2015

(Continued)

OTHER PUBLICATIONS

International Search Report and Written Opinion dated Mar. 16, 2017 for PCT/US2016/046660.

(Continued)

*Primary Examiner* — Andrew L Sniezek
(74) *Attorney, Agent, or Firm* — Patterson + Sheridan, LLP

(57) ABSTRACT

Systems and methods of simulating acoustic output at a location corresponding to source position data are disclosed. A particular method includes receiving an audio signal and source position data associated with the audio signal. A set of speaker signals are applied to a plurality of speakers, where the set of speaker driver signals causes the plurality of speakers to generate acoustic output that simulates output of the audio signal by an audio source at a location corresponding to the source position data.

36 Claims, 6 Drawing Sheets

Related U.S. Application Data continuation of application No. 14/791,758, filed on Jul. 6, 2015, now Pat. No. 9,854,376.

(51) Int. Cl.

| | |
|---|---|
| ***H04S 7/00*** | (2006.01) |
| ***H04R 1/32*** | (2006.01) |
| *H04S 3/00* | (2006.01) |
| *H04R 5/02* | (2006.01) |

(52) U.S. Cl.

CPC ..... *H04R 5/023* (2013.01); *H04R 2499/13* (2013.01); *H04S 3/008* (2013.01); *H04S 2400/03* (2013.01); *H04S 2400/11* (2013.01)

(56) References Cited

U.S. PATENT DOCUMENTS

| | | | | |
|---|---|---|---|---|
| 7,630,500 | B1 | 12/2009 | Beckman et al. | |
| 7,792,674 | B2 | 9/2010 | Dalton, Jr. et al. | |
| 8,218,783 | B2 | 7/2012 | Katzer et al. | |
| 8,325,936 | B2 | 12/2012 | Eichfeld et al. | |
| 8,483,413 | B2 | 7/2013 | Hartung et al. | |
| 8,724,827 | B2 | 5/2014 | Hartung et al. | |
| 9,002,829 | B2 * | 4/2015 | Chan | G06F 16/68 707/722 |
| 9,049,534 | B2 | 6/2015 | Eichfeld et al. | |
| 9,100,748 | B2 | 8/2015 | Hartung et al. | |
| 9,100,749 | B2 | 8/2015 | Hartung et al. | |
| 9,167,344 | B2 | 10/2015 | Choueiri | |
| 9,338,554 | B2 | 5/2016 | Christoph | |
| 9,357,304 | B2 | 5/2016 | Christoph | |
| 9,854,376 | B2 | 12/2017 | Vautin et al. | |
| 2003/0142835 | A1 | 7/2003 | Enya et al. | |
| 2004/0196982 | A1 | 10/2004 | Aylward et al. | |
| 2005/0213528 | A1 | 9/2005 | Aarts et al. | |
| 2006/0045294 | A1 | 3/2006 | Smyth | |
| 2007/0006081 | A1 | 1/2007 | Maehata et al. | |
| 2007/0053532 | A1 | 3/2007 | Elliott et al. | |
| 2008/0273722 | A1 | 11/2008 | Aylward et al. | |
| 2010/0158263 | A1 | 6/2010 | Katzer et al. | |
| 2012/0213375 | A1 * | 8/2012 | Mahabub | H04S 5/00 381/17 |
| 2013/0136281 | A1 | 5/2013 | Steffens et al. | |
| 2013/0177187 | A1 | 7/2013 | Mentz | |
| 2013/0178967 | A1 | 7/2013 | Mentz | |
| 2014/0119581 | A1 | 5/2014 | Tsingos et al. | |
| 2014/0133658 | A1 | 5/2014 | Mentz et al. | |
| 2014/0133672 | A1 | 5/2014 | Lakkundi et al. | |
| 2014/0334637 | A1 | 11/2014 | Oswald et al. | |
| 2014/0334638 | A1 | 11/2014 | Barksdale et al. | |
| 2014/0348354 | A1 | 11/2014 | Christoph et al. | |
| 2015/0242953 | A1 | 8/2015 | Suiter | |
| 2016/0142852 | A1 | 5/2016 | Christoph | |
| 2016/0205473 | A1 | 7/2016 | Rodigast et al. | |
| 2018/0103332 | A1 | 4/2018 | Vautin et al. | |

FOREIGN PATENT DOCUMENTS

| | | | |
|---|---|---|---|
| EP | 1858296 | A1 | 11/2007 |
| EP | 2445759 | A2 | 5/2012 |
| EP | 2816824 | A2 | 12/2014 |
| JP | 2006-222686 | A | 8/2006 |
| JP | 2008158868 | A | 7/2008 |
| JP | 2013-211906 | A | 10/2013 |
| JP | 2016-523045 | A | 8/2016 |
| WO | 2009012496 | A2 | 1/2009 |
| WO | 2012141057 | A1 | 10/2012 |
| WO | 2014035728 | A2 | 3/2014 |
| WO | 2014043501 | A1 | 3/2014 |
| WO | 2014159272 | A1 | 10/2014 |

OTHER PUBLICATIONS

Invitation to Pay Additional Fees dated Nov. 7, 2016 for PCT/US2016/046660.

International Search Report and Written Opinion dated Oct. 7, 2016 for PCT/US2016/040270.

International Search Report and Written Opinion dated Oct. 6, 2016 for PCT/US2016/040285.

EP Office Action for EP application No. 16 745 272.1-1207 dated Nov. 9, 2018.

First Office Action for Chinese Application No. 201680048979.7 dated Dec. 27, 2018.

First Office Action for Japanese Patent Application No. 2018-500435 dated Mar. 4, 2019.

Decision of Rejection/Refusal for Japanese Patent Application No. 2018-500435 dated Jun. 27, 2019.

* cited by examiner

SIMULATING ACOUSTIC OUTPUT AT A LOCATION CORRESPONDING TO SOURCE POSITION DATA

I. CROSS REFERENCE TO RELATED APPLICATIONS

The present application is a continuation of U.S. patent application Ser. No. 15/831,536, filed on Dec. 5, 2017, which is a continuation of U.S. patent application Ser. No. 14/791,758, filed on Jul. 6, 2015, now U.S. Pat. No. 9,854,376.

II. FIELD OF THE DISCLOSURE

The present disclosure is generally related to simulating acoustic output, and more particularly, to simulating acoustic output at a location corresponding to source position data.

III. BACKGROUND

Automobile speaker systems can provide announcement audio, such as automatic driver assistance system (ADAS) alerts, navigation alerts, and telephony audio, to occupants from static (e.g., fixed) permanent speakers. Permanent speakers project sound from predefined fixed locations. Thus, for example, ADAS alerts are output from a single speaker (e.g., a driver's side front speaker) or from a set of speakers based on a predefined setting. In other examples, navigation alerts and telephone calls are projected from fixed speaker locations that provide the announcement audio throughout a vehicle.

IV. SUMMARY

In selected examples, a method includes receiving an audio signal and source position data associated with the audio signal is received. The method also includes applying a set of speaker driver signals to a plurality of speakers. The set of speaker driver signals causes the plurality of speakers to generate acoustic output that simulates output of the audio signal by an audio source at a location corresponding to the source position data.

In another aspect, an apparatus includes a plurality of speakers and an audio signal processor configured to receive an audio signal and source position data associated with the audio signal. The audio signal processor is also configured to apply a set of speaker driver signals to the plurality of speakers. The set of speaker driver signals causes the plurality of speakers to generate acoustic output that simulates output of the audio signal by an audio source at a location corresponding to the source position data.

In another aspect, a machine-readable storage medium has instructions stored thereon to simulate acoustic output. The instructions, when executed by a processor, cause the processor to receive an audio signal and source position data associated with the audio signal. The instructions, when executed by the processor, also cause the processor to apply a set of speaker driver signals to a plurality of speakers. The set of speaker driver signals causes the plurality of speakers to generate acoustic output that simulates output of the audio signal by an audio source at a location corresponding to the source position data.

V. BRIEF DESCRIPTION OF THE DRAWINGS

Various other objects, features and attendant advantages will become fully appreciated as the same becomes better understood when considered in conjunction with the accompanying drawings such that like reference characters designate the same or similar parts throughout the several views, and wherein.

VI. DETAILED DESCRIPTION

In selected examples, an audio system dynamically selects and precisely simulates announcement audio in an acoustic space. Utilizing an x-y coordinate position grid outlining an acoustic space, the audio system device drives speaker driver signals to simulate acoustic output at precise locations in response to prompts by, for example, an ADAS, a navigation system, or mobile device. In one aspect, the audio system relocates the simulation locations over the acoustic space, whether inside or outside a vehicle that is in motion or that is at rest, in real-time. Advantageously, the audio system supports ADAS, navigation, and telephone technologies in delivering greater customization and improvements to the vehicle transport experience.

Figure 1:
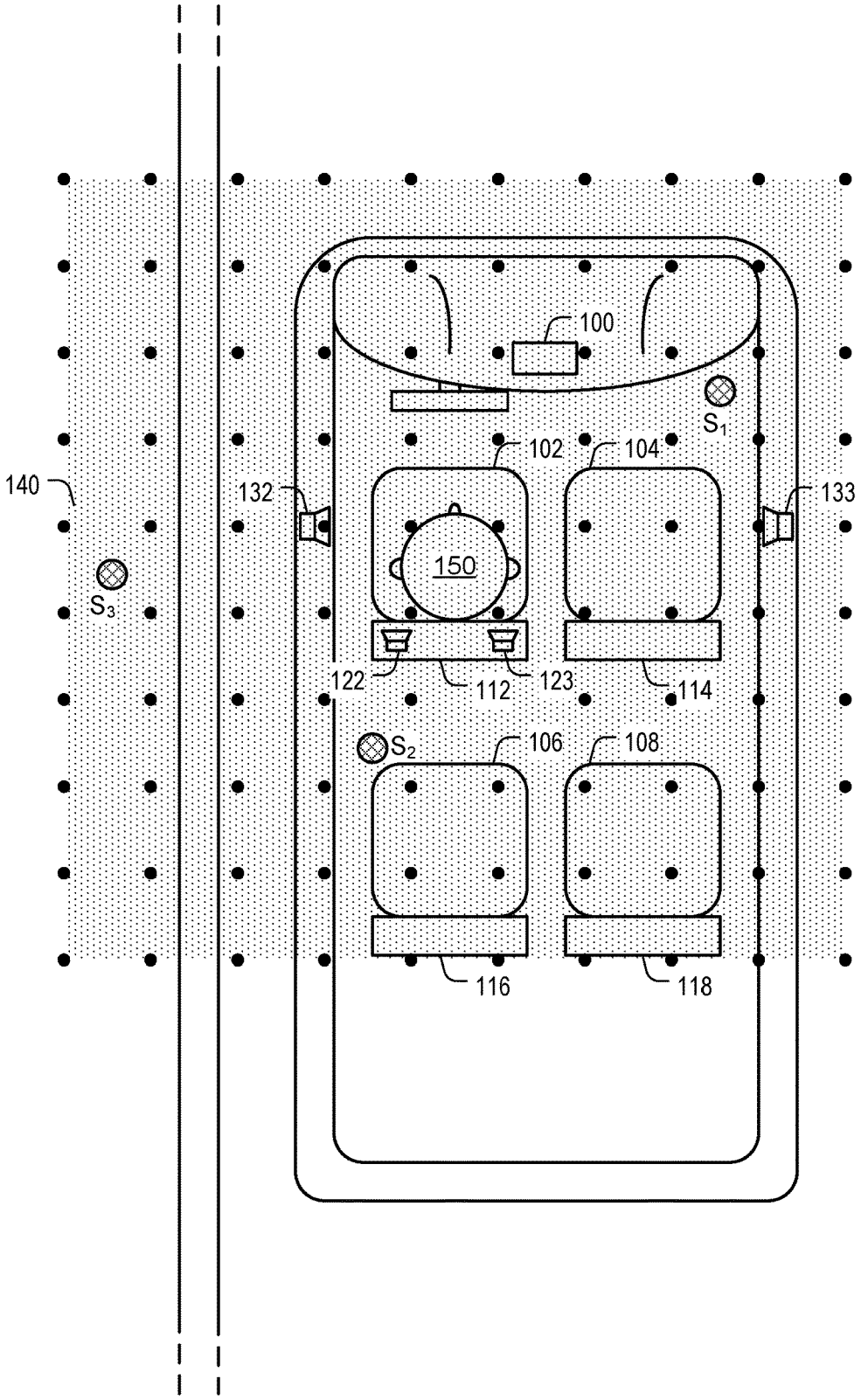
FIG. 1 is an illustrative diagram of a vehicle compartment having an audio system configured to simulate acoustic output at a location corresponding to source position data.

FIG. 1 is an illustrative diagram of a vehicle compartment having an audio system 100 configured to simulate acoustic output (e.g., announcement audio) at a location corresponding to source position data. The location can be any location inside of an illustrative grid 140, e.g., a two-dimensional claim corresponding to an acoustic space. The audio system 100 includes a combined source/processing/amplifying module, which is implemented using hardware (e.g., an audio signal processor), software, or a combination thereof. In some examples, the capabilities of the audio system 100 are divided between various components. For example, a source can be separated from amplifying and processing capabilities. In some examples, the processing capability is supplied by software loaded onto a computing device that performs source, processing, and/or amplifying functionality. In particular aspects, signal processing and amplification is provided by the audio system 100 without specifying any particular system architecture or technology.

The vehicle compartment shown in FIG. 1 includes four car seats 102, 104, 106, 108 having headrests 112, 114, 116, 118, respectively. As a non-limiting example, two headrest speakers 122, 123 are shown to be mounted on the headrest 112. In other examples, headrest speakers 122, 123 are located within the headrest 112. While the other headrests 114, 116, and 118 are not shown to have headrest speakers in the example of FIG. 1, other examples include one or more headrest speakers in any combination of the headrests 112, 114, 116, and 118.

As shown in FIG. 1, the headrest speakers 122, 123 are positioned near the ears of a listener 150, who in the example of FIG. 1 is the driver of the vehicle. The headrest speakers 122, 123 are operated, individually or in combination, to control distribution of sound to the ears of the listener 150. In some implementations, as shown in FIG. 1, the headrest speakers 122, 123 are coupled to the audio system 100 via wired connections through the seat 102 to supply power and provide wired connectivity. In other examples, the headrest speakers 122, 123 are connected to the audio system 100 wirelessly, such as in accordance with one more wireless communication protocols (e.g. Institute of Electrical and Electronics Engineers (IEEE) 802.11, Bluetooth, etc.).

The vehicle compartment further includes two fixed speakers 132, 133 located on or in the driver side and front passenger side doors. In other examples, a greater number of speakers are located in different locations around the vehicle compartment. In some implementations, the fixed speakers 132, 133 are driven by a single amplified signal from the audio system 100, and a passive crossover network is embedded in the fixed speakers 132, 133 and used to distribute signals in different frequency ranges to the fixed speakers 132, 133. In other implementations, the amplifier module of the audio system 100 supplies a band-limited signal directly to each fixed speaker 132, 133. The fixed speakers 132, 133 can be full range speakers.

In some examples, each of the individual speakers 122, 123, 132, 133 corresponds to an array of speakers that enables more sophisticated shaping of sound, or a more economical use of space and materials to deliver a given sound pressure level. The headrest speakers 122, 123 and the fixed speakers 132, 133 are collectively referred to herein as real speakers, real loudspeakers, fixed speakers, or fixed loudspeakers interchangeably.

The grid 140 illustrates an acoustic space within which any location can be dynamically selected by the audio system 100 to generate acoustic output. In the example of FIG. 1, the grid 140 is 10×10 x-y coordinate grid that includes one hundred grid points. In other examples, greater or fewer grid points are used to define an acoustic space. The grid 140 is dynamically movable corresponding to vehicle movements to maintain x-y spatial dimensions. Advantageously, in one example, the audio system 100 enables audio projections from any spot within the acoustic area to the example listener 150. Moreover, as shown in FIG. 1, the grid 140 includes grid points that are within the vehicle compartment as well as grid points that are outside the vehicle compartment. It should therefore be understood that the audio system 100 is capable of simulating acoustic output for locations outside of the vehicle compartment.

In FIG. 1, positions $S_1$, $S_2$, and $S_3$ illustrate exemplary location positions where sound is shown to be projected. An example of operation at the audio system 100 is now described with reference to FIG. 2. As shown at 210, an advanced driver assistance system (ADAS) 201, a global positioning system (GPS) navigation system 202, and/or a mobile device 203, (e.g., an audio source, such as a mobile telephone, tablet computer, personal media player, etc.) are paired with the vehicle audio system 100 to generate an audio signal 211 and associated source position data 212. As shown at 220, the audio signal 211 and the source position data 212 are provided to the audio system 100.

The audio system 100 determines a set of speaker driver signals 220 to apply to speakers 221 (e.g., speakers 122, 123, 132, 133; FIG. 1). The set of speaker driver signals 220 causes the speakers 221 to generate acoustic output 230 that simulates output of the audio signal 211 by an audio source at a particular location (e.g., an illustrative source position 231) corresponding to the source position data 212. To illustrate, the source position 231 can be one of the simulated locations $S_1$, $S_2$, and $S_3$ in FIG. 1. Projection of sound with respect to the positions $S_1$, $S_2$, and $S_3$ is further described with reference to FIG. 4.

Advantageously, in particular examples, the audio system 100 of the present disclosure dynamically selects source positions from which audio output is perceived to be projected in real-time (or near-real-time), such as when prompted by another device or system. The real and virtual speakers simulate audio energy output to appear to project from these specific and discrete locations.

Figure 2:
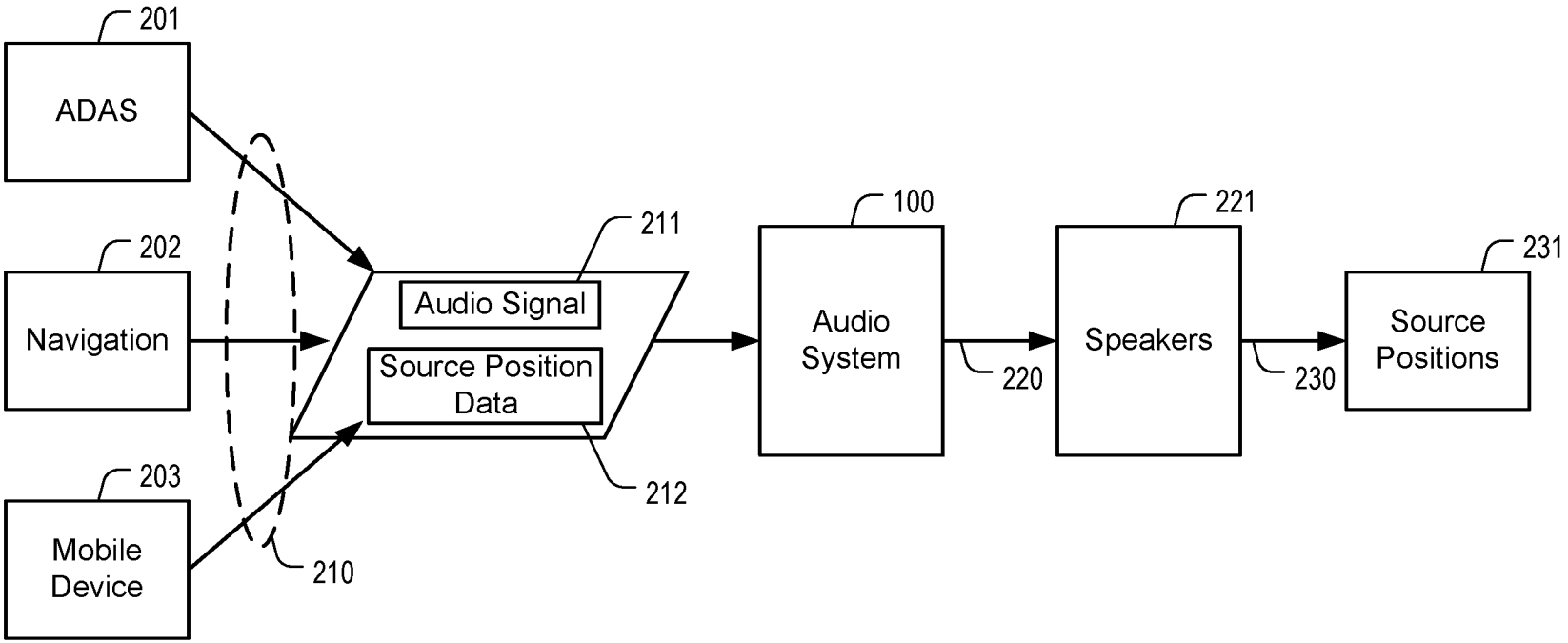
FIG. 2 is a flow diagram of the processing signal flow of an audio system configured to simulate acoustic output at a location corresponding to source position data.
Figure 3:
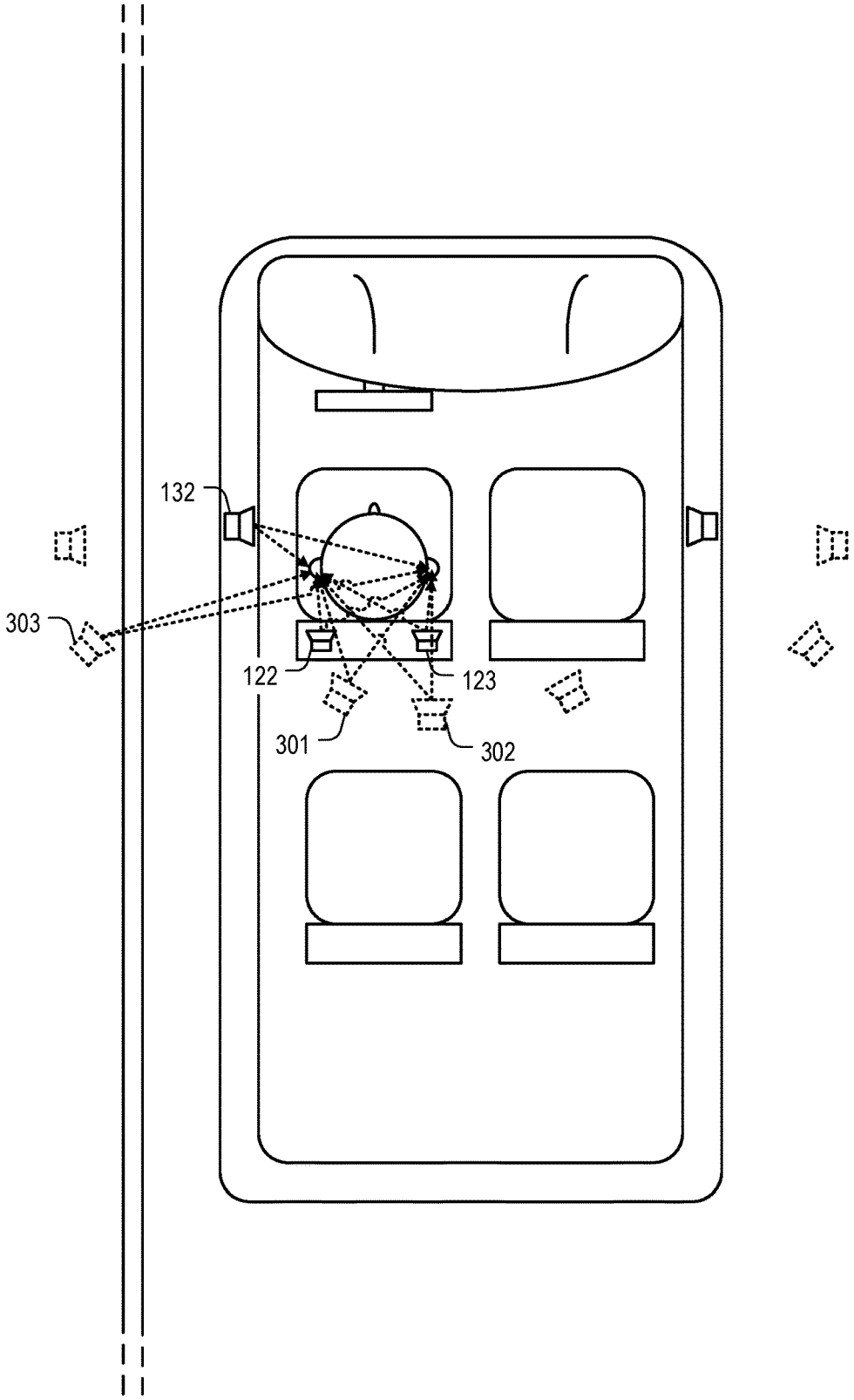
FIG. 3 is an illustrative diagram of speakers of an audio system configured to simulate acoustic output at a location corresponding to source position data.

For example, FIG. 3 illustrates real and virtual speakers used by an implementation of the audio system 100 of FIG. 1 to simulate acoustic output at a location corresponding to source position data. In FIG. 3, real speakers are shown in solid line and virtual speakers are shown in dashed line. The virtual speakers can be "preset" and correspond to speaker locations that are discrete, predefined, and/or static locations where acoustic output is simulated by applying binaural signal filters to an up-mixed component of an input audio signal (e.g., the audio signal 211 of FIG. 2). In one example, binaural signal filters are utilized to modify the sound played back at the headrest speakers 122, 123 (FIG. 1) so that the listener 150 perceives the filtered sound as if it is coming from the virtual speakers rather than from the actual (fixed) headrest speakers.

In accordance with the techniques of the present disclosure, the virtual speakers also have the ability to precisely simulate acoustic output at a specific location in response to, and when prompted by, multiple types of systems, including but not limited to the ADAS 201, the navigation system 202, and the mobile device 203 of FIG. 2.

As shown in FIG. 3, the left ear and right ear of the listener (e.g., the listener 150 of FIG. 1) receive acoustic output energy in different amounts from each real and virtual speaker. For example, FIG. 3 includes dashed arrows illustrating the different paths that acoustic energy or sound travels from the real speakers 122, 123, 132 and virtual speakers 301, 302, 303. Notably, as shown in FIG. 3, the virtual speakers can be inside the vehicle compartment (e.g., the virtual speakers 301, 302) as well as outside the vehicle compartment (e.g., the virtual speaker 303). Acoustic energy paths for the remaining real and virtual speakers of FIG. 3 are omitted for clarity.

It should be noted that, in particular aspects, various signals assigned to each real and virtual speaker are superimposed to create an output signal, and some of the energy from each speaker can travel omnidirectionally (e.g., depending on frequency and speaker design). Accordingly, the arrows illustrated in FIG. 3 are to be understood as conceptual illustrations of acoustic energy from different combinations of real and virtual speakers. In examples where speaker arrays or other directional speaker technologies are used, the signals provided to different combinations of speakers provide directional control. Depending on design, such speaker arrays are placed in headrests as shown or in other locations relatively close to the listener, including but not limited to locations in front of the listener.

In some examples, the headrest speakers 122, 123 are used, with appropriate signal processing, to expand the spaciousness of the sound perceived by the listener 150, and more specifically, to control a sound stage. Perception of a sound stage, envelopment, and sound location is based on level and arrival-time (phase) differences between sounds arriving at both of the listener's ears. The sound stage is controlled, in particular examples, by manipulating audio signals produced by the speakers to control such inter-aural level and time differences. As described in commonly assigned U.S. Pat. No. 8,325,936, which is incorporated herein by reference, headrest speakers as well as fixed non-headrest speakers can be used to control spatial perception.

The listener 150 hears the real and virtual speakers near his or her head. Acoustic energy from the various real and virtual speakers will differ due to the relative distances between the speakers and the listener's ears, as well as due to differences in angles between the speakers and the listener's ears. Moreover, for some listeners, the anatomy of outer ear structures is not the same for the left and right ears. Human perception of the direction and distance of sound sources is based on a combination of arrival time differences between the ears, signal level differences between the ears, and the particular effect that the listener's anatomy has on sound waves entering the ears from different directions, all of which is also frequency-dependent. The combination of these factors at both ears, for an audio source at a particular x-y location of the grid 140 of FIG. 1, can be represented by a magnitude adjusted linear sum of (e.g., signals corresponding to) the four closest grid points to the audio source on the grid 140. For example, binaural and/or transducing signal filters (or other signal processing operations) are used to shape sound that will be reproduced at the speakers to cause the sound to be perceived as if it originated at the particular x-y location of the grid 140, as further described with reference to FIG. 4.

Figure 4:
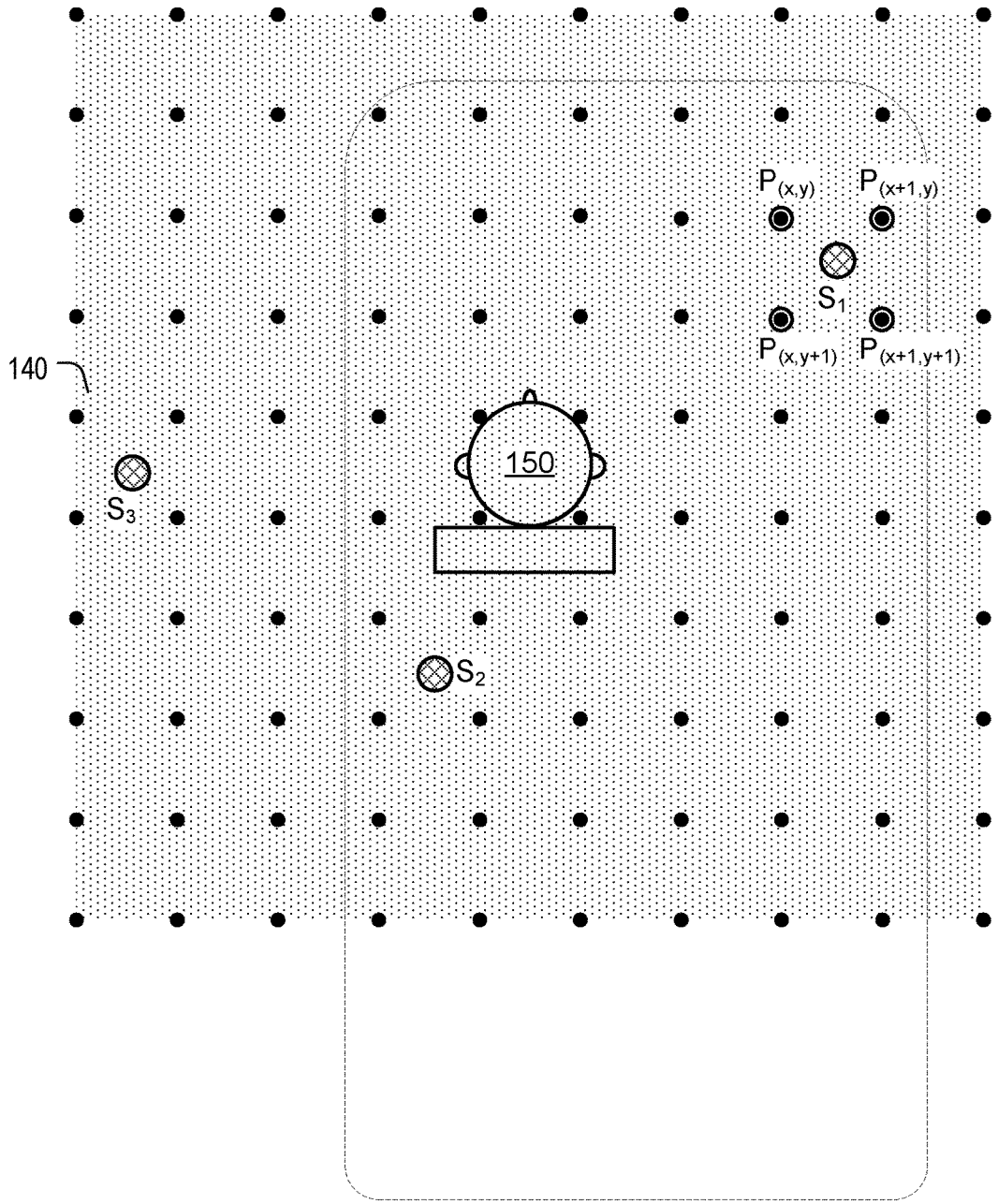
FIG. 4 is a diagram of a grid defining an acoustic space of an audio system configured simulate acoustic output at a location corresponding to source position data.

FIG. 4 depicts an example in which the listener 150 hears the acoustic output 230 projected from the locations $S_1$, $S_2$, and $S_3$ at various different times based on varying criteria as provided, for example, by the ADAS 201, the navigation system 202, and/or the mobile device 203 of FIG. 2. While these features of the present disclosure are described with reference to the locations of $S_1$, $S_2$, and $S_3$, other alternative implementations generate acoustic output simulations from any location within the grid 140 that forms the acoustic space.

In a first illustrative non-limiting example, acoustic output 230 corresponding to the announcement audio that is perceived to originate from the location $S_1$ (to the front-right of the listener 150) relates to the navigation system 202 informing the listener 150 that he or she is to make a right turn. Advantageously, because the simulated announcement audio is projected from a location in front of and to the right of the listener 150, the listener 150 quickly and easily comprehends the right-turn travel direction instruction with reduced thought or effort.

In FIG. 4, example grid points $P_{(x,y)}$, $P_{(x+1,y)}$, $P_{(x,y+1)}$, and $P_{(x+1,\ y+1)}$ are the four closest grid points to the location $S_1$. In particular implementations, a magnitude adjusted linear sum of signal components of these four grid points is used to project the simulated acoustic output 230 from the location $S_1$ As a second illustrative non-limiting example, the acoustic output 230 projected from the example location $S_2$ (behind and slightly to the left of the listener 150) relates to audio announcement output from the ADAS 201 warning the listener 150 that there is a vehicle in the listener's blind spot. Advantageously, the listener 150 would now quickly and easily know not to switch lanes to the left at that particular moment in time.

As a third illustrative non-limiting example, the location $S_2$ relates to the audio announcement output from the mobile device 203, such as a mobile phone. Advantageously, as the acoustic output 230 is projected near the listener's ear, the listener 150 can take the call with greater privacy, and without disturbing other passenger's in the vehicle. In this example, listener position data indicating a location of the listener 150 within the vehicle compartment is provided along with the source position data 212 (e.g., so that the acoustic output for the telephone call is projected near the correct driver/passenger's ears).

As a fourth illustrative non-limiting example, the listener 150 receives the acoustic output 230 simulated from the location $S_3$ (outside the vehicle). In this example, the acoustic output 230 corresponds to announcement audio from the ADAS 201 informing the listener 150 that a pedestrian (or other object) has been detected to be walking (or moving) towards the vehicle from the location $S_3$. Advantageously, the listener 150 can quickly and easily know to take precautions and avoid a collision with the pedestrian (or other object).

In one aspect, the audio system 100 is used in conjunction with the ADAS system 201 to dynamically (e.g., in real-time or near-real-time) simulate acoustic output 230 from any location within the grid 140 for features including, but not limited to, rear cross traffic, blind spot recognition, lane departure warnings, intelligent headlamp control, traffic sign recognition, forward collision warnings, intelligent speed control, pedestrian detection, and low fuel. In another aspect, the audio system 100 is used in combination with the navigation system 202 to dynamically project audio output from any source position such that navigation commands or driving direction information can be simulated at precise locations within the grid 140. In a third aspect, the audio system 100 is used in conjunction with the mobile device 203 to dynamically simulate audio output from any source position such that a telephone call is presented in close proximity to any particular passenger sitting in any of the car seats within the vehicle compartment.

Figure 5:
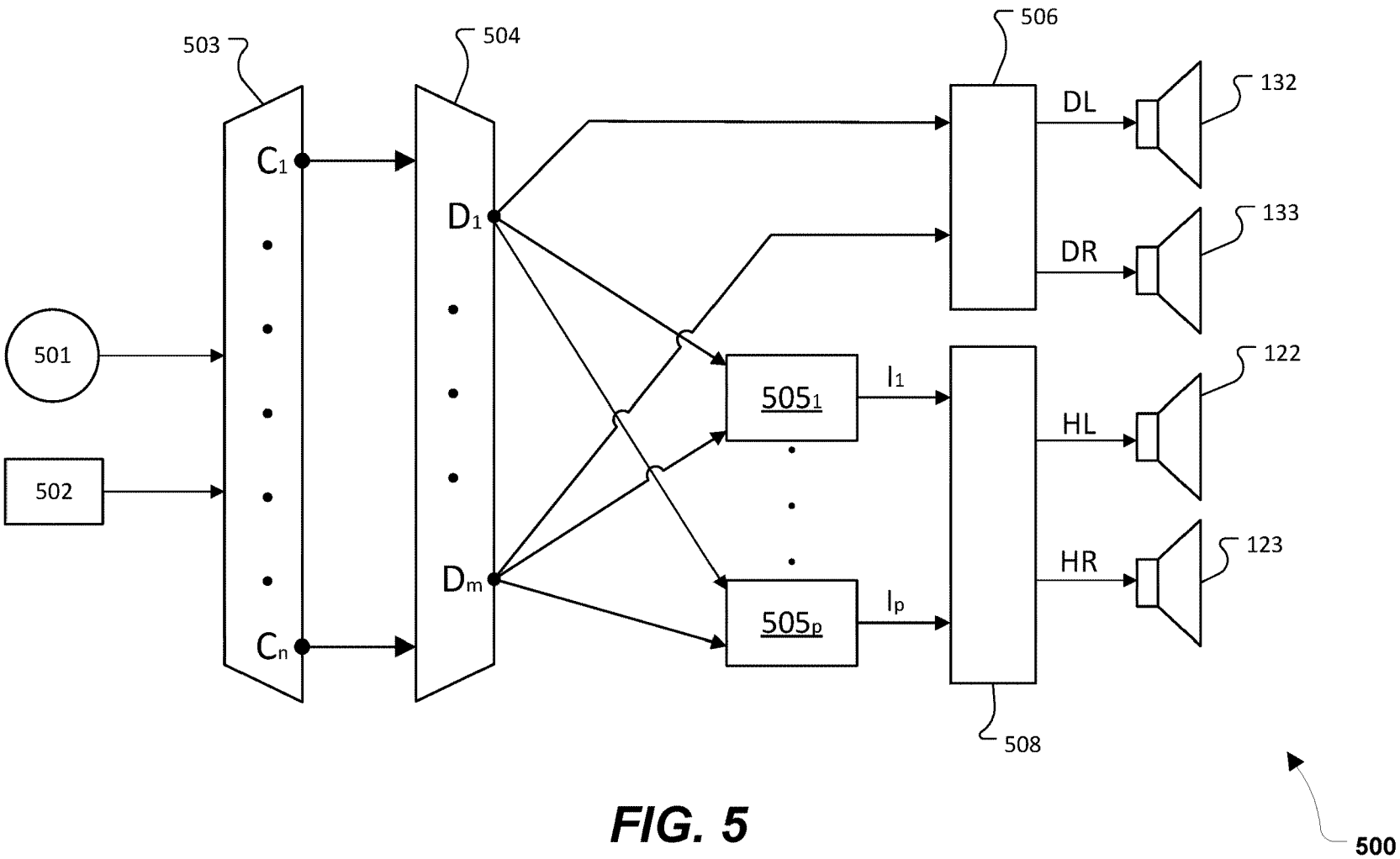
FIG. 5 is a schematic diagram of an audio system configured to simulate acoustic output at a location corresponding to source position data.

FIG. 5 is a schematic diagram of an audio system 500 configured to simulate acoustic output at a source position corresponding to source position data. In an illustrative example, the system 500 corresponds to the system 100 of FIG. 1.

In the example of FIG. 5, an input audio signal channel 501 (e.g., the input audio signal 211 of FIG. 2) along with audio source position data 502 (e.g., source position data 212 of FIG. 2) is routed to an audio up-mixer module 503. In some aspects, the input audio signal channel 501 corresponds to a single channel (e.g., monaural) audio data. The audio up-mixer module 503 converts the input audio signal channel 501 into an intermediate number of components $C_1$-$C_n$, as shown. The intermediate components $C_1$-$C_n$ correspond to grid points on the grid 140 of FIG. 1 and are related to the different mapped locations from where the acoustic output 230 is simulated. As used herein, the term "component" is used to refer to each of the intermediate directional assignments from where the original input audio signal channel 501 is up-mixed. In the example of the 10×10 grid 140, there are 100 corresponding components, each of which corresponds to a particular one of the 10×10=100 grid points. In other examples, more or fewer grid points and intermediate components are used. It should be noted that any number of up-mixed components are possible, e.g., based on available processing power at the audio system 100 and/or content of the input audio signal channel 501.

The up-mixer module 503 utilizes coordinates provided in the audio source position data to generate a vector of n gains, which assign varying levels of the input (announcement audio) signal to each of the up-mixed intermediate components $C_1$-$C_n$. Next, as shown in FIG. 5, the up-mixed intermediate components $C_1$-$C_n$ are down-mixed by an audio down-mixer module 504 into intermediate speaker signal components $D_1$-$D_m$, where m is the total number of speakers, including both real and virtual speakers.

Binaural filters 505$_1$-505$_p$ then convert weighted sums of the intermediate speaker signal components $D_1$-$D_m$ into binaural image signals $I_1$-$I_p$, where p is the total number of virtual speakers. The binaural image signals $I_1$-$I_p$ correspond to sound coming from the virtual speakers (e.g., speakers 301-303; FIG. 1). While FIG. 5 shows each of the binaural filters 505$_1$-505$_p$ receiving all of the intermediate speaker signal components, in practice, each virtual speaker will likely reproduce sounds from only a subset of the intermediate speaker signal components $D_1$-$D_m$, such as those components associated with a corresponding side of the vehicle. Remixing stages 506 (only one shown) combine the intermediate speaker signal components to generate the speaker driver signals DL and DR for delivery to the forward mounted fixed speakers 132, 133, and a binaural mixing stage 508 combines the binaural image signals $I_1$-$I_p$ to generate the two speaker driver signals HL and HR for the headrest speakers 122, 123.

The fixed speakers 122, 123, 132, and 133 transduce the speaker driver signals HL, HR, DL, and DR and thereby reproduce the announcement audio such that it is perceived by the listener as coming from the precise location indicated in the audio source position data.

One example of such a re-mixing procedure is described in commonly-assigned U.S. Pat. No. 7,630,500, which is incorporated herein by reference. In the example of FIG. 5, speaker driver signals DL, DR, HL, and HR, are generated, via re-mixing and recombination, for delivery to real speakers, such as the left door speaker (DL) 132 of FIG. 1, the right door speaker (DR) 133 of FIG. 1, the left headrest speaker (HL) 122 of FIG. 1, and the headrest right speaker (HR) 123 of FIG. 1. In particular aspects, prior to mixing, each of the image signals $I_1$-$I_p$ is filtered to create the desired soundstage. The soundstage filtering applies frequency response equalization of magnitude and phase to each of the image signals $I_1$-$I_p$. Alternatively, the soundstage filters are applied before binaural filters are applied, or are integrated with the binaural filters. It should be understood that the signal processing technology used by the audio system 100 differs based on the hardware and tuning techniques used in a given application or setting.

It should also be noted that while FIG. 5 illustrates that four speaker driver signals are output, this is an example for clarity. More or fewer output signals are generated in other examples, based on the number of real speakers available. In other implementations, the signal processing methodology of FIG. 5 is used to generate speaker driver signals for the other passenger headrests 114, 116, 118 of FIG. 1, and/or any additional speakers or speaker arrays. Various component signals topologies are possible based on signal combination and conversion into binaural signals, and a particular topology can be selected based on the processing capabilities of the audio system 100, the processes used to define the tuning of the vehicle, etc.

Figure 6:
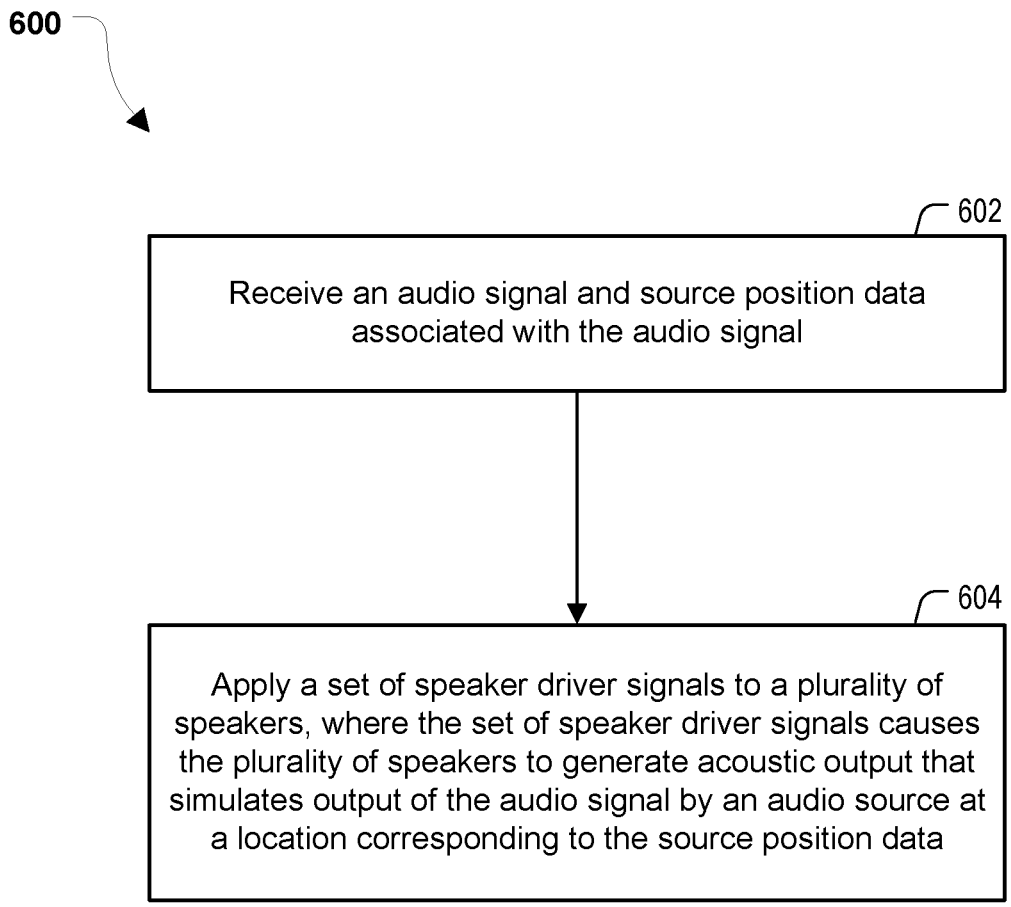
FIG. 6 is a flowchart of a method of simulating acoustic output at a location corresponding to source position data.

FIG. 6 is a flowchart of a method 600 of simulating acoustic output at a location corresponding to source position data. In an illustrative implementation, the method 600 is performed by the audio system 100 of FIG. 1.

The method 600 includes receiving an audio signal and source position data associated with the audio signal, at 602. For example, as described with reference to FIGS. 1-2, the audio system 100 receives the input audio signal 211 and the associated source position data 212.

The method 600 also includes applying a set of speaker driver signals to a plurality of speakers, at 604. The set of speaker driver signals causes the plurality of speakers to generate acoustic output that simulates output of the audio signal by an audio source at a location corresponding to the source position data. For example, as described with reference to FIG. 2, the speaker driver signals 220 are generated and applied to simulate audio at a location (e.g., $S_1$, $S_2$, or $S_3$) corresponding to the source position data 212.

While examples have been discussed in which headrest mounted speakers are utilized, in combination with binaural filtering, to provide virtualized speakers, in some cases, the speakers may be located elsewhere in proximity to an intended position of a listener's head, such as in the vehicle's headliner, visors, or in the vehicle's B-pillars. Such speakers are referred to generally as "near-field speakers." In some examples, as shown in FIG. 3, the fixed speaker(s), such as the speaker 132, are forward of the near-field speaker(s), such as the speakers 301-303.

In some examples, implementations of the techniques described herein include computer components and computer-implemented steps that will be apparent to those skilled in the art. In some examples, one or more signals or signal components described herein include a digital signal. In some examples, one or more of the system components described herein are digitally controlled, and the steps described with reference to various examples are performed by a processor executing instructions from a memory or other machine-readable or computer-readable storage medium.

It should be understood by one of skill in the art that the computer-implemented steps can be stored as computer-executable instructions on a computer-readable medium such as, for example, floppy disks, hard disks, optical disks, flash memory, nonvolatile memory, and random access memory (RAM). In some examples, the computer-readable medium is a computer memory device that is not a signal. Furthermore, it should be understood by one of skill in the art that the computer-executable instructions can be executed on a variety of processors such as, for example, microprocessors, digital signal processors, gate arrays, etc. For ease of description, not every step or element of the systems and methods described above is described herein as part of a computer system, but those skilled in the art will recognize that each step or element can have a corresponding computer system or software component. Such computer system and/or software components are therefore enabled by describing their corresponding steps or elements (that is, their functionality) and are within the scope of the disclosure.

Those skilled in the art can make numerous uses and modifications of and departures from the apparatus and techniques disclosed herein without departing from the inventive concepts. For example, components or features illustrated or describe in the present disclosure are not limited to the illustrated or described locations. As another example, examples of apparatuses in accordance with the present disclosure can include all, fewer, or different components than those described with reference to one or more of the preceding figures. The disclosed examples should be construed as embracing each and every novel feature and novel combination of features present in or possessed by the apparatus and techniques disclosed herein and limited only by the scope of the appended claims, and equivalents thereof.

What is claimed is:

1. A method comprising:

receiving, by an audio system in a vehicle, an audio signal and source position data associated with the audio signal;

up-mixing the audio signal to generate a plurality of intermediate signal components, wherein the up-mixing comprises generating a vector of n gains, which assign levels of the audio signal to each of the intermediate signal components;

down-mixing the plurality of intermediate signal components to generate a plurality of speaker signal components; and processing the plurality of speaker signal components to generate a set of speaker driver signals that cause a plurality of speakers distributed within the vehicle to simulate output of the audio signal at a location corresponding to the source position data, wherein the plurality of speakers comprise a plurality of near-field speakers, and a plurality of fixed speakers located forward of the near-field speakers;

wherein the set of speaker driver signals comprises a first plurality of speaker driver signals for delivery to the plurality of near-field speakers, and a second plurality of speaker driver signals for delivery to the plurality of fixed speakers located forward of the near-field speakers; and wherein processing the plurality of speaker signal components comprises:

binaural filtering a subset of the plurality of speaker signal components to generate a plurality of binaural image signals;

filtering the plurality of binaural image signals by applying frequency response equalization of magnitude and phase to the plurality of binaural image signals;

combining the plurality of filtered binaural image signals to generate the first plurality of speaker driver signals; and combining the plurality of speaker signal components to generate the second plurality of speaker driver signals.

2. The method of claim 1, wherein the set of speaker driver signals corresponds to one or more fixed speakers, one or more virtual speakers, or a combination thereof.

3. The method of claim 1, wherein the location corresponding to the source position data is distinct from locations of the plurality of speakers.

4. The method of claim 1, further comprising applying a second set of speaker driver signals to the plurality of speakers to generate acoustic output corresponding to a second location that is different from the location.

5. The method of claim 1, wherein the audio signal, the source position data, or both are received from an automatic driver assistance system, a navigation system, or a mobile device.

6. The method of claim 1, wherein generating the set of speaker driver signals comprises binaural filtering.

7. The method of claim 1, wherein each of the plurality of intermediate signal components corresponds to a respective point on a two-dimensional plane corresponding to an acoustic space.

8. The method of claim 1, wherein the location corresponding to the source position data is associated with a magnitude adjusted linear sum of signals corresponding to a plurality of points in an acoustic space.

9. The method of claim 1, wherein the source position data includes listener position data associated with a listener location.

10. The method of claim 1, wherein the audio signal is a single channel audio signal.

11. The method of claim 1, wherein the audio signal corresponds to announcements associated with at least one of an automatic driver assistance system, a navigation system, or a mobile device.

12. A method comprising:

receiving, by an audio system in a vehicle, an audio signal and source position data associated with the audio signal;

up-mixing the audio signal to generate a plurality of intermediate signal components;

down-mixing the plurality of intermediate signal components to generate a plurality of speaker signal components; and processing the plurality of speaker signal components to generate a set of speaker driver signals that cause a plurality of speakers distributed within the vehicle to simulate output of the audio signal at a location corresponding to the source position data, wherein the simulated output includes an acoustic space comprising a first location within the vehicle and a second location outside of the vehicle;

wherein the plurality of speakers comprise a plurality of near-field speakers, and a plurality of fixed speakers located forward of the near-field speakers;

wherein the set of speaker driver signals comprises a first plurality of speaker driver signals for delivery to the plurality of near-field speakers, and a second plurality of speaker driver signals for delivery to the plurality of fixed speakers located forward of the near-field speakers; and wherein processing the plurality of speaker signal components comprises:

binaural filtering a subset of the plurality of speaker signal components to generate a plurality of binaural image signals;

filtering the plurality of binaural image signals by applying frequency response equalization of magnitude and phase to the plurality of binaural image signals;

combining the plurality of filtered binaural image signals to generate the first plurality of speaker driver signals; and combining the plurality of speaker signal components to generate the second plurality of speaker driver signals.

13. The method of claim 12, wherein up-mixing the audio signal to generate the plurality of intermediate signal components comprises:

generating a vector of n gains, which assign levels of the audio signal to each of the intermediate signal components.

14. The method of claim 12, wherein the set of speaker driver signals corresponds to one or more fixed speakers, one or more virtual speakers, or a combination thereof.

15. The method of claim 12, wherein the location corresponding to the source position data is distinct from locations of the plurality of speakers.

16. The method of claim 12, further comprising applying a second set of speaker driver signals to the plurality of speakers to generate acoustic output corresponding to a second location that is different from the location.

17. The method of claim 12, wherein the audio signal, the source position data, or both are received from an automatic driver assistance system, a navigation system, or a mobile device.

18. The method of claim 12, wherein generating the set of speaker driver signals comprises binaural filtering.

19. The method of claim 12, wherein each of the plurality of intermediate signal components corresponds to a respective point on a two-dimensional plane corresponding to an acoustic space.

20. The method of claim 12, wherein the location corresponding to the source position data is associated with a magnitude adjusted linear sum of signals corresponding to a plurality of points in an acoustic space.

21. The method of claim 12, wherein the source position data includes listener position data associated with a listener location.

22. The method of claim 12, wherein the audio signal is a single channel audio signal.

23. The method of claim 12, wherein the audio signal corresponds to announcements associated with at least one of an automatic driver assistance system, a navigation system, or a mobile device.

24. An apparatus comprising:

a plurality of speakers distributed within a vehicle, and an audio signal processor configured to:

receive an audio signal and source position data associated with the audio signal;

up-mix the audio signal to generate a plurality of intermediate signal components by generating a vector of n gains, which assign levels of the audio signal to each of the plurality of intermediate signal components;

down-mix the plurality of intermediate signal components to generate a plurality of speaker signal components; and process the plurality of speaker signal components to generate a set of speaker driver signals that cause the plurality of speakers to simulate output of the audio signal at a location corresponding to the source position data, wherein the plurality of speakers comprise a plurality of near-field speakers, and a plurality of fixed speakers located forward of the near-field speakers;

wherein the set of speaker driver signals comprises a first plurality of speaker driver signals for delivery to the plurality of near-field speakers, and a second plurality of speaker driver signals for delivery to the plurality of fixed speakers located forward of the near-field speakers; and wherein processing the plurality of speaker signal components comprises:

binaural filtering a subset of the plurality of speaker signal components to generate a plurality of binaural image signals;

filtering the plurality of binaural image signals by applying frequency response equalization of magnitude and phase to the plurality of binaural image signals;

combining the plurality of filtered binaural image signals to generate the first plurality of speaker driver signals; and combining the plurality of speaker signal components to generate the second plurality of speaker driver signals.

25. The apparatus of claim 24, wherein the set of speaker driver signals corresponds to one or more fixed speakers, one or more virtual speakers, or a combination thereof.

26. The apparatus of claim 24, wherein the location corresponding to the source position data is distinct from locations of the plurality of speakers.

27. The apparatus of claim 24, wherein the audio signal processor is further configured to apply a second set of speaker driver signals to the plurality of speakers to generate acoustic output corresponding to a second location that is different from the location.

28. The apparatus of claim 24, wherein the audio signal, the source position data, or both are received from an automatic driver assistance system, a navigation system, or a mobile device.

29. The apparatus of claim 24, wherein the audio signal processor is configured to generate the set of speaker driver signals by binaural filtering.

30. An apparatus comprising:

a plurality of speakers distributed within a vehicle, and an audio signal processor configured to:

receive an audio signal and source position data associated with the audio signal;

up-mix the audio signal to generate a plurality of intermediate signal components;

down-mix the plurality of intermediate signal components to generate a plurality of speaker signal components; and process the plurality of speaker signal components to generate a set of speaker driver signals that cause the plurality of speakers distributed within the vehicle to simulate output of the audio signal at a location corresponding to the source position data, wherein the simulated output includes an acoustic space comprising a first location within the vehicle and a second location outside of the vehicle;

wherein the plurality of speakers comprise a plurality of near-field speakers, and a plurality of fixed speakers located forward of the near-field speakers;

wherein the set of speaker driver signals comprises a first plurality of speaker driver signals for delivery to the plurality of near-field speakers, and a second plurality of speaker driver signals for delivery to the plurality of fixed speakers located forward of the near-field speakers; and wherein processing the plurality of speaker signal components comprises:

binaural filtering a subset of the plurality of speaker signal components to generate a plurality of binaural image signals;

filtering the plurality of binaural image signals by applying frequency response equalization of magnitude and phase to the plurality of binaural image signals;

combining the plurality of filtered binaural image signals to generate the first plurality of speaker driver signals; and combining the plurality of speaker signal components to generate the second plurality of speaker driver signals.

31. The apparatus of claim 30, wherein the audio signal processor is configured to up-mix the audio signal to generate the plurality of intermediate signal components by generating a vector of n gains, which assign levels of the audio signal to each of the intermediate components.

32. The apparatus of claim 30, wherein the set of speaker driver signals corresponds to one or more fixed speakers, one or more virtual speakers, or a combination thereof.

33. The apparatus of claim 30, wherein the location corresponding to the source position data is distinct from locations of the plurality of speakers.

34. The apparatus of claim 30, wherein the audio signal processor is further configured to apply a second set of speaker driver signals to the plurality of speakers to generate acoustic output corresponding to a second location that is different from the location.

35. The apparatus of claim 30, wherein the audio signal, the source position data, or both are received from an automatic driver assistance system, a navigation system, or a mobile device.

36. The apparatus of claim 30, wherein the audio signal processor is configured to generate the set of speaker driver signals by binaural filtering.

* * * * *